United States Patent [19]

Iles

[11] 4,178,138

[45] Dec. 11, 1979

[54] CARTRIDGE FOR PERISTALTIC PUMP

[76] Inventor: Frank Iles, "Loscombe", Four Lanes, Redruth, Cornwall, TR 16 6LP, England

[21] Appl. No.: 790,892

[22] Filed: Apr. 26, 1977

[30] Foreign Application Priority Data

May 5, 1976 [GB] United Kingdom ..... 18471/76

[51] Int. Cl.[2] ..... F04B 43/08; F04B 43/12; F04B 45/06

[52] U.S. Cl. ..... 417/360; 417/477; 418/70

[58] Field of Search ..... 417/477, 476, 475, 360; 418/45, 56, 39, 70; 29/156.4 R; 222/209, 214, 325

[56] References Cited

U.S. PATENT DOCUMENTS

| | | | |
|---|---|---|---|
| 2,696,173 | 12/1954 | Jensen | 417/477 |
| 2,899,907 | 8/1959 | Becher | 417/477 |
| 3,249,059 | 3/1966 | Renn | 417/477 |
| 3,565,554 | 2/1971 | Muller | 417/477 |
| 3,674,383 | 7/1972 | Iles | 417/476 |
| 3,955,902 | 5/1976 | Kyusgaard | 417/477 |

FOREIGN PATENT DOCUMENTS

| | | | |
|---|---|---|---|
| 620871 | 3/1949 | United Kingdom | 417/476 |
| 897022 | 5/1962 | United Kingdom | 417/477 |

*Primary Examiner*—Carlton R. Croyle
*Assistant Examiner*—Thomas I. Ross
*Attorney, Agent, or Firm*—Roylance, Abrams, Berdo & Farley

[57] ABSTRACT

A cartridge for a peristaltic pump comprises two parts having a frusto-conical bore extending through the two parts and a dovetail section groove encircling the bore at the joint between the two parts. A liquid carrying tube extends into the cartridge and has a convolution encircling the bore. The tube has an integral dovetail section rib extending along the length thereof which engages in the dovetail section groove encircling the bore to locate the tube in the bore. The cartridge is used with a pump having a rotor with one or more rollers mounted eccentrically thereon to rotate about axes convergent with the rotor axis. The rollers compress and flatten the tube where they engage it so that as the rollers rotate around the bore in the cartridge, liquid in the tube is displaced along the tube in a continuous flow.

4 Claims, 9 Drawing Figures

CARTRIDGE FOR PERISTALTIC PUMP

BACKGROUND OF THE INVENTION

1. Field of the Invention

The invention relates to cartridges for peristaltic pumps.

2. Description of the Prior Art

My U.K. Pat No. 1274749 describes and illustrates a peristaltic pump comprising a pump housing having a frusto-conical internal bore, a flexible tube extending into and out of the bore in the housing through the walls thereof and having a convolution encircling the bore. The pump further comprises a motor having an output shaft coaxial with the frusto-conical bore and having a disc on which a roller is eccentrically mounted to traverse and compress the convolution of the tube mounted within the bore.

Movement of the tube in the axial direction of the bore is not constrained and is now considered to be disadvantageous. An object of this invention is therefore to overcome that disadvantage.

SUMMARY OF THE INVENTION

The invention provides a cartridge for a peristaltic pump comprising a housing having a bore to receive a rotary member of the pump, a flexible walled tube extending through the housing with at least a part of a convolution of the tube encircling the bore to receive a rotary member of the pump for traversing the convolution and, by depressing the tube, causing a flow of fluid therein, the tube having an integral rib extending lengthwise which narrows in cross-section to a neck adjacent the tube and the housing being formed with a recess encircling the bore in which the rib engages, the recess having a mouth at the bore of similar width to the neck so that the rib is trapped in the recess.

The invention also provides a peristaltic pump having a cartridge according to the above arrangement, the pump having a mounting to receive the cartridge and a motor driven rotor rotatable about the axis of the bore and having at least one eccentrically mounted element thereon for engaging and pressing the wall of the tube.

DESCRIPTION OF THE PREFERRED EMBODIMENTS

Figure 1:
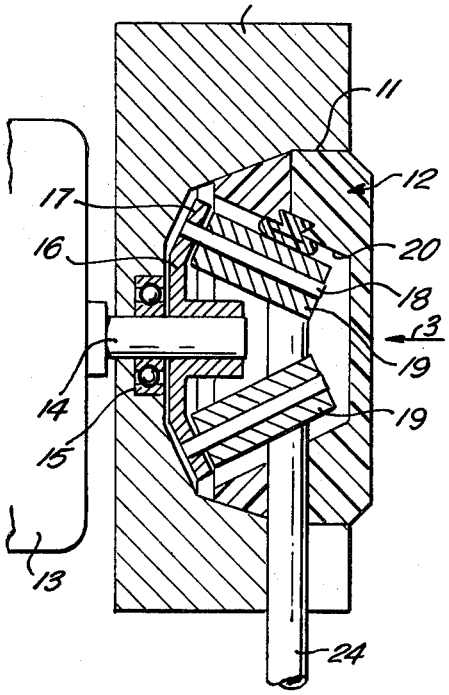
FIG. 1 is a partly sectioned diagrammatic view of the peristaltic pump having a cartridge through which a feed tube extends.
Figure 3:
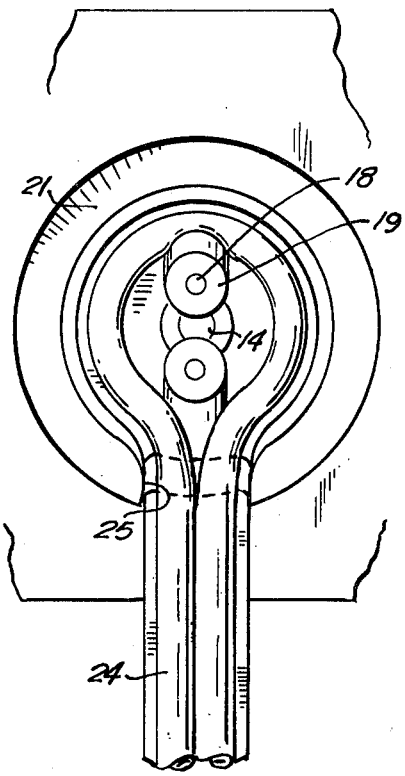
FIG. 3 is a view looking in the direction of the arrow 3 on FIG. 1.

Referring firstly to FIGS. 1 to 4 of the drawings, there is shown a peristaltic pump comprising a main housing 10 having a circular socket 11 in which the cartridge 12 is mounted. The pump has an electric drive motor 13 having an output shaft 14 which is supported in a bearing 15 and extends coaxially into the socket 11.

A disc 16 is mounted on the shaft 14 in the socket, the disc having an inclined peripheral flange 17 and two shafts 18 are mounted at diametrically spaced locations around the disc on the inclined portion so that the shafts converge towards the axis of the shaft 14. Cylindrical rollers 19 are rotatably mounted on the shafts 18.

Figure 4:
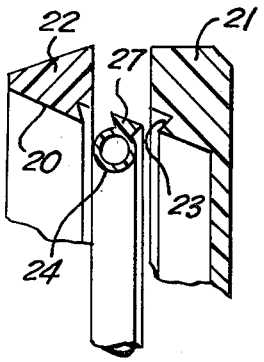
FIG. 4 shows part of the cartridge during its assembly.

As indicated earlier, a cartridge 12 is mounted in the socket 11 in the housing. The cartridge has a frusto-conical bore 20 and is formed in two parts 21, 22 located end-to-end along the bore. A dovetail section groove 23 is formed around the bore 20 at the joint between the two parts 21, 22 of the cartridge. There is a radial opening 25 through the wall of the cartridge at the bottom thereof and a silicon rubber tube 24 forming part of a blood supply system has a portion extending through the opening 25 into the cartridge and formed into a convolution 26 encircling the bore of the cartridge. The tube 24 is formed with a dovetailed section rib 27 extending along the length thereof which is trapped in the dovetail section groove 23 in the cartridge to hold the tube in place in the bore 20. FIG. 4 of the drawings shows the assembly of the cartridge, the dovetail section rib 27 being trapped in the groove 23 as the two parts 21 and 22 are brought together and then secured together.

Referring again to FIG. 1 of the drawings, the cartridge 12 is located in the socket 11 and is locked in place by means not shown. The rollers 19 rotate about axes generally parallel to the frusto-conical bore 20 in the cartridge and are set up during manufacture of the pump to flatten fully the tube 24 where they engage the tube. Thus as the disc 16 rotates the rollers 19 one after the other displace fluid along the tube to produce a continuous flow of fluid along the tube.

Figure 5:
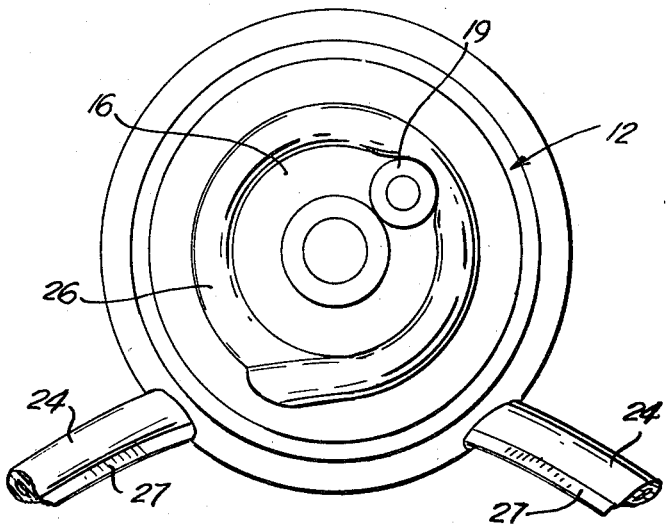
FIGS. 5 and 6 show two modified forms of pump and cartridge.

FIG. 5 of the drawings illustrates a modification to the above construction in which the disc 16 carries only a single roller 19 and the ends of the convolution 26 of the tube 24 are overlapped, entering and exiting from the cartridge through openings **25*a*, 25*b* spaced around the cartridge. As the single roller 19 reaches the end of the convolution 26** of the bottom of the cartridge it comes again into contact with the beginning of the convolution. Thus the fluid being pumped is prevented from passing back around the convolution and is continually forced through the tube.

Figure 6:
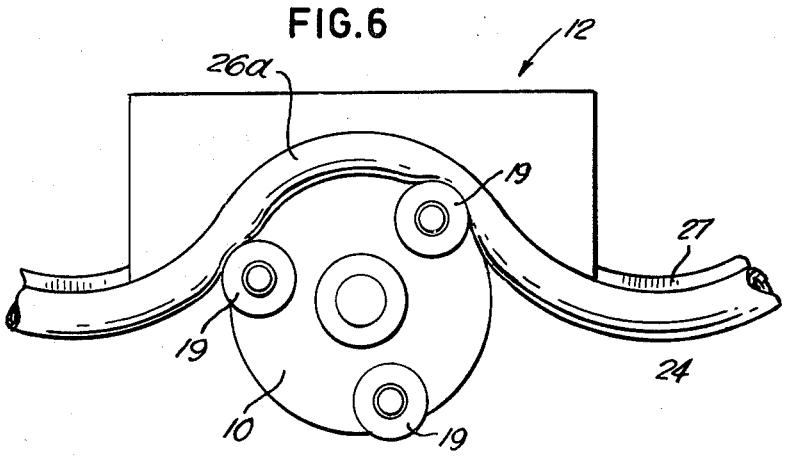

In the arrangement shown in FIG. 6, the disc 16 has three equally spaced rollers 19 thereon and the cartridge presents only a part of a convolution **26*a*** for engagement by the rollers. The arcuate length of the part of the tube is equivalent to one third of the circumference of the path of the rollers so that as one roller reaches an end of its traverse along the tube the next roller comes into engagement with the tube. This ensures a continuous pumping action and no back flow.

Figure 7:
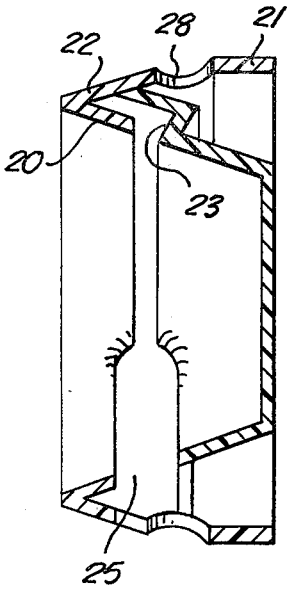
FIG. 7 is a section through a further construction of cartridge.

FIG. 7 of the drawings shows an alternative construction of cartridge which is generally similar to that described above and like parts have been allotted the same reference numerals. The two parts 21, 22 of the cartridge are formed from clear plastics mouldings and have an outer encircling groove 28 for locking the cartridge in the socket in the pump housing as described below.

Figure 2:
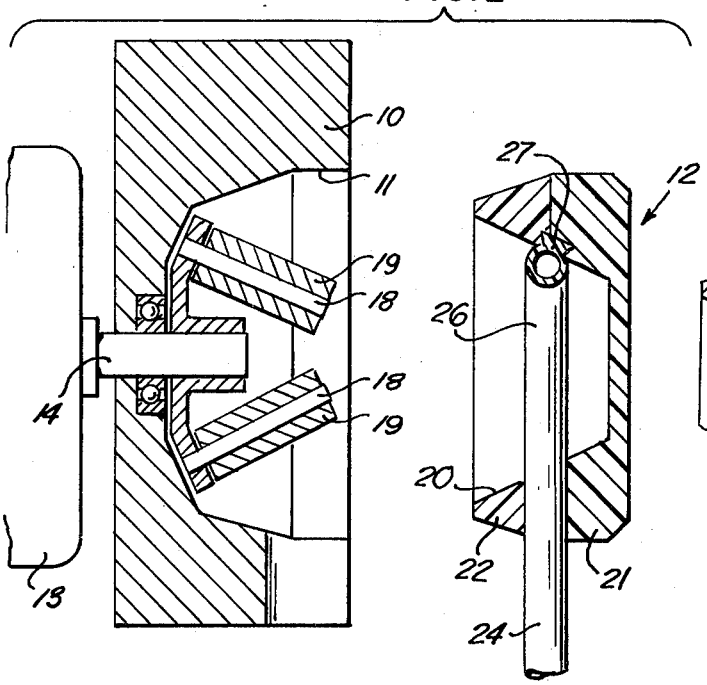
FIG. 2 is a similar view to FIG. 1 showing the pump and cartridge separated.
Figure 8:
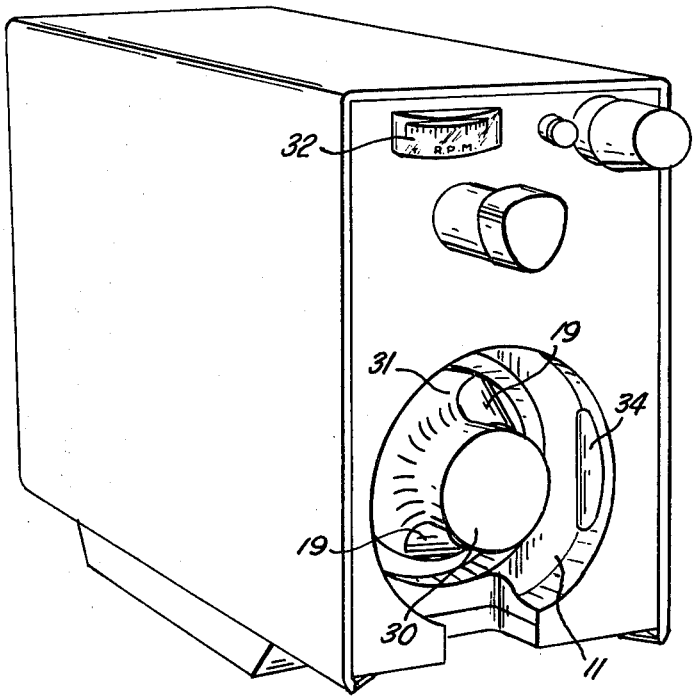
FIG. 8 is a perspective view of a further pump construction.

Referring now to FIG. 8 of the drawings, there is shown an alternative form of pump housing which is again generally similar to that described with reference to FIGS. 1 and 2 above. In the arrangement shown in FIG. 6 the end of the shaft 14 projecting into the socket 11 carries an enlarged boss 30 having an outwardly projecting flange 31 adjacent the bottom of the socket. The two rollers 19 are partially buried in the boss 30 and flange 31 so that only portions of the rollers project outwardly to engage the tube in the cartridge. The rollers are formed from molybdenum disulphide filled nylon.

The motor driving the shaft of the pump has a speed indicator 32 and a control 33 for varying the speed of the motor and thereby the flow rate of fluid through the tube.

Figure 9:
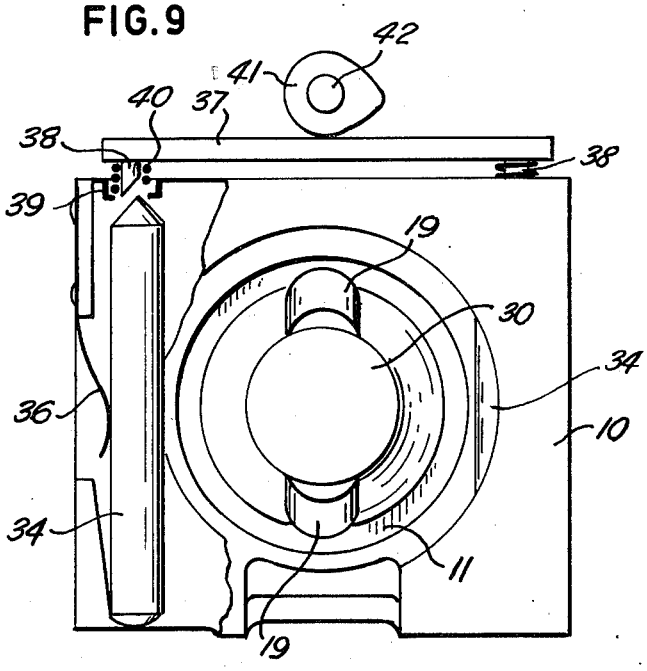
FIG. 9 is a diagrammatic view of part of the pump of FIG. 8 showing a locking mechanism for the cartridge.

Referring now to FIG. 9, a clamping arrangement for securing cartridge 12 in the socket 11 is provided comprising a pair of elongate stainless steel pins 34 which extend downwardly on either side of the socket 11. The pins break into the socket through openings 35 to engage in the groove 28 in the cartridge and thereby lock the cartridge in the socket. The pins are mounted in the housing for movement outwardly of the socket and are biassed inwardly by leaf springs 36 mounted on the housing. The upper end of both pins are conical and a locking bar 37 is mounted towards the upper end of the housing having two downwardly extending abutments 38 each having an inclined lower face 39 to engage and drive the upper ends of the pins 34 inwardly so that the pins project into the socket 11. The abutments 38 are encircled by compression springs 40 which bias the locking bar 37 upwardly and the bar engages under a cam 41 mounted on a shaft 42 to which a knob 43 on the front face of the housing is attached. The shaft 42 also operates an on-off switch for the motor drive for the pump and is arranged so that in one position the locking pins 34 are released so that a cartridge can be inserted in or removed from the pump and the motor is off, a second position in which the locking bar 37 is driven downwardly to lock the pins 34 and thereby hold the cartridge in place in the socket with the motor remaining off and a third position in which the locking pins 34 are locked and the motor is switched on.

It will be understood that many modifications may be made to the above described embodiments without departing from the scope of the invention. For example, the tube 24 may be formed with a rib of different section reducing to a neck adjacent the tube and the groove 23 is then formed with a corresponding cross-section having a mouth at the bore of similar width to the neck to trap and hold the rib in place in the groove.

Also the shaft 14 may be arranged to be adjustable axially to vary the extent to which the rollers 19 compress the tube 24 and thereby vary the fluid flow rate along the tube for a given pump speed.

I claim:

1. A peristaltic pump comprising body means having a chamber with an open mouth;

a rotary member mounted in said body means for rotation in said chamber; and a cartridge adapted to be releasably mounted in said chamber through said open mouth, said cartridge comprising a housing with a bore for receiving said rotary member when said cartridge is mounted in said chamber, a tube with a flexible wall extending through said housing, said tube having a convolution with at least a part thereof encircling said bore, a rib integrally mounted on said tube and extending along the longitudinal extent thereof, said rib narrowing in cross section to a neck adjacent said tube, and a recess formed in said housing and encircling said bore, said recess having a width similar to that of said neck to entrap the rib therein and thereby hold said tube in said bore;

said rotary member being rotatable about the axis of the bore and having at least one eccentrically mounted element thereon for engaging and pressing the wall of the tube; and clamping means for releasably holding said cartridge in said chamber, said clamping means including openings on opposite sides of the encircling wall of said chamber, a pair of pins extending through said body means with one pin on each side of said body means;

resilient biasing means for resiliently biasing said pins so that the side portions thereof project into said chamber through said openings;

a groove on the outer surface of said cartridge adapted to receive the side portions of said pins, and releasable locking means for holding said pins in said opening to hold said cartridge in place when located in said chamber;

whereby, upon rotation of said rotary member when said cartridge is in said chamber, said rotary member traverses said convolution and, by depressing said tube, causes fluid in said tube to flow.

2. A pump according to claim 1, wherein said locking means includes a manual control which in a first position releases said pins for movement against said biasing means, which in a second position prevents said pins from moving out of said openings, and which in a third position both prevents said pins from moving out of said openings and energizes a motor for rotating said rotary member.

3. A peristaltic pump comprising body means having a chamber with an open mouth;

a rotary member mounted in said body means for rotation in said chamber;

a cartridge adapted to be releasably mounted in said chamber through said open mouth, said cartridge comprising a housing with a bore for receiving said rotary member when said cartridge is mounted in said chamber, a tube with a flexible wall extending through said housing, said tube having a convolution with at least a part thereof encircling said bore, an integral rib integrally mounted on said tube and extending along the longitudinal extent thereof, said rib narrowing in cross section to a neck adjacent said tube;

a recess formed in said housing and encircling said bore, said recess having a width similar to that of said neck to entrap the rib therein and thereby hold said tube in said bore; and clamp means for releasably holding said cartridge in said chamber comprising openings on opposite sides of the encircling wall of said chamber, a pair of pins extending through said body means with one pin on each side of said body means;

resilient biasing means for resiliently biasing said pins so that the side portions thereof project into said chamber through said openings, a groove on the outer surface of said cartridge adapted to receive the side portions of said pins, and releasable locking means for holding said pins in said openings to hold said cartridge in place when located in said chamber.

whereby, upon rotation of said rotary member when said cartridge is in said chamber, said rotary member traverses said convolution, and by depressing said tube, causes fluid in said tube to flow.

4. A pump according to claim 3, wherein said locking means includes a manual control which in a first position releases said pins for movement against said biasing means, which in a second position prevents said pins from moving out of said openings, and which in a third position both prevents said pins from moving out of said openings and energizes a motor for rotating said rotary member.

* * * * *